United States Patent [19]

Piascinski

[11] 4,217,014

[45] Aug. 12, 1980

[54] METHOD FOR ASSEMBLING A BASE TO AN ELECTRON TUBE

[75] Inventor: Joseph J. Piascinski, Leola, Pa.

[73] Assignee: RCA Corporation, New York, N.Y.

[21] Appl. No.: 8,176

[22] Filed: Jan. 31, 1979

[51] Int. Cl.[2] ..... H01J 9/30

[52] U.S. Cl. ..... 316/17; 29/25.13

[58] Field of Search ..... 316/1, 17, 26; 29/25.11, 25.13; 156/275

[56] References Cited

U.S. PATENT DOCUMENTS

| | | | |
|---|---|---|---|
| 3,278,886 | 10/1966 | Blumenberg et al. | 339/145 |
| 3,433,687 | 3/1969 | Price | 156/275 |
| 3,966,287 | 6/1976 | Liller | 316/1 |
| 3,979,157 | 9/1976 | DiMattio | 339/145 T |
| 4,040,707 | 8/1977 | Pisano | 339/111 |
| 4,040,708 | 8/1977 | Neuber et al. | 339/111 |
| 4,043,722 | 8/1977 | Baker et al. | 425/174.8 |
| 4,064,412 | 12/1977 | Johnson | 313/318 |
| 4,076,366 | 2/1978 | Wardell, Jr. et al. | 339/144 T |
| 4,127,313 | 11/1978 | Marks | 339/144 T |

*Primary Examiner*—John McQuade

*Attorney, Agent, or Firm*—E. M. Whitacre; G. H. Bruestle; L. Greenspan

[57] ABSTRACT

After an electron tube is exhausted and sealed, a base is pushed into position on the stem of the tube, the space between the stem and the base, at least around one pin of the tube, is filled with a sealing substance, and then the stem is heated until the sealing substance is at least partially cured by heat from the stem to form a dielectric material.

5 Claims, 4 Drawing Figures

METHOD FOR ASSEMBLING A BASE TO AN ELECTRON TUBE

This invention relates to a method for assembling a base to a vacuum electron tube, such as a CRT (cathode-ray tube).

An electron tube, such as a CRT, comprises generally an evacuated glass envelope including a glass stem comprising a glass wafer having a plurality of metal pins or leads extending therethrough. Active or functional parts inside the tube including the electrodes and cathodes are connected to the pins. During the operation of the tube, suitable voltages are applied to the pins from outside the tube to cause the tube to function. A base is usually attached to the stem of the tube after the tube has been exhausted of gases and hermeticaly sealed, and prior to electrically processing the electrodes and activating the cathode or cathodes of the tube.

U.S. Pat. No. 3,278,886 to H. H. Blumenberg et al, issued Oct. 11, 1966, points out that, in many CRTs, particularly picture tubes for television receivers, the spacings between the focusing anode pin and the adjacent pins have been decreased, and the voltage applied to the focusing anode pin has been increased, producing higher electric field gradients adjacent the focusing anode pin. To reduce arcing from the focusing anode pin when the voltages are applied to the pins, an insulating base of special design is attached to the stem and pins. A mass of dielectric material is placed between the base and the stem around the focusing anode pin to reduce arcing in that particular region. One type of dielectric material that has been suggested is a moisture-cured RTV (room temperature vulcanizing) silicone rubber. Such an RTV rubber is ordinarily cast in place by filling the desired space with an uncured sealing substance in the form of a viscous liquid or paste. The substance then cures at room temperature over an extended period of time to a solid rubber by the action of ambient humidity. To be effective in suppressing arcing, the rubber must be free of bubbles and well adhered to the surfaces near the pin.

As pointed out in U.S. Pat. No. 4,040,708 to R.E. Neuber et al, issued Aug. 9, 1977, the process for applying and curing an RTV silicone rubber is difficult to control and requires a trained operator. Also, as pointed out in U.S. Pat. No. 4,076,366 to M. H. Wardell, Jr. et al, issued Feb. 28, 1978, an RTV silicone rubber suffers from the disadvantage of requiring a rather lengthy curing time, which causes a slowdown on the production line. Part of the problem of using a mass of RTV silicone rubber is that, ordinarily, the sealing substance cures from the outside surface thereof and progresses inwardly. In so doing, a skin forms on the mass and slows the entry of additional moisture into the mass. When heat is applied to accelerate the curing, the heat progresses from the outside surface of the mass inwardly and further retards the entry of additional moisture for curing the inside of the mass. Because the interior of the mass of sealing substance remains substantially uncured, movement of the base with respect to the stem may form bubbles of air adjacent the pins. Air spaces adjacent the pins provide an easy arcing path.

SUMMARY OF THE INVENTION

The novel method uses, as in prior methods, a sealing substance which cures in place to a solid, dielectric material. And, furthermore, such curing is at least initiated, and preferably accelerated, by applied heat. Such substance and the base are assembled to the stem of the tube prior to electrode processing. Then, departing from the prior methods, the wafer and pins are heated to such temperatures and for such time periods as to at least partially cure the mass of sealing substance for at least a substantial distance adjacent the pin or pins intended for carrying a substantially higher voltage than the adjacent pins. Heat from the pins, and particularly the focusing anode pin, is conducted into the interior of the mass of sealing substance initiating and accelerating the curing of the substance from the inside thereof, particularly at the surfaces of the stem and the base near the pin, and progressing outwardly. The source of the heat for heating the pins is preferably the by-product of processing the electrodes in the normal course of tube making. Measurements have shown that such processing normally causes the temperature in the space between the stem and the base to rise to at least 165° C.

Through the selection of the uncured sealing substance and the application of heat through the pins and the stem, a sufficiently cured dielectric material, such as a silicone rubber, can be produced easily between the base and the stem with no slowdown on the production line. Also, since the mass of sealing substance first cures near the pins, subsequent movement of the base with respect to the stem is less likely to produce bubbles of air adjacent the pins. The novel method permits energy savings in tube basing and avoids the additional costs of storing and handling tubes while waiting for sufficient curing to be completed.

DETAILED DESCRIPTION OF THE PREFERRED EMBODIMENTS

Figure 1:
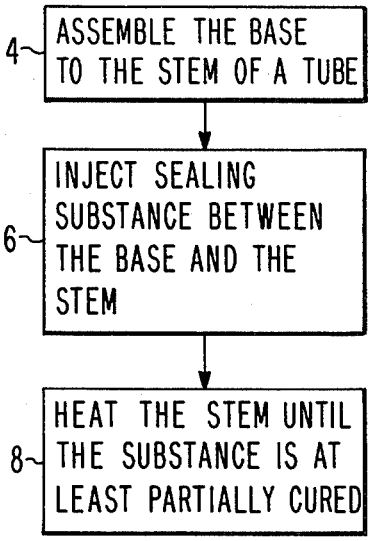
FIG. 1 is a flow-sheet diagram of the novel method.

FIG. 1 is a flow-sheet diagram of the novel method, which comprises three principal steps. The base is assembled to the stem of the tube as indicated by the box designated 4. Then, a sealing substance is injected into the desired space between the base and the tube, as indicated by the box designated 6. Then, the stem is heated until the substance is at least partially cured, as indicated by the box designated 8. The substance can be completely cured, but it is sufficient that the curing be substantially completed only around the particular pins of interest; that is, the pins intended for carrying high voltage and for the pins adjacent to those pins.

Figure 2:
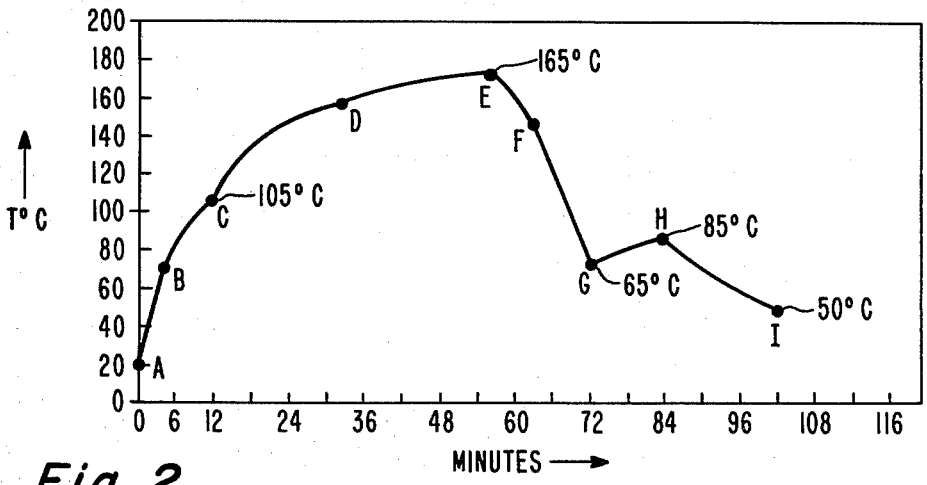
FIG. 2 is a curve showing the measured temperature between the stem and the base during electrode processing of a CRT.

It is preferred to use the heat that is generated in the tube during the electrical processing of the tube for curing the substance. Such electrical processing can include spot knocking, high-voltage aging, cathode activation and cathode aging. Heat generated during such electrical processing passes into the stem and can raise the temperature in the region between the base and the stem to about 175° C. during a processing schedule which usually lasts about 60 to 120 minutes. FIG. 2 is a curve showing the measured temperature between the base and the stem of a CRT taken with a thermocouple as the tube was subjected to one particular processing schedule. It is the heat from electrical processing that can be used to initiate, and at least partially cure, the sealing substance to a dielectric material. The curve in FIG. 2 indicates some significant periods in the processing schedule as follows: A is the start of the schedule at room temperature, B is the end of cathode activation or hot shot, B to C is a period with only filament voltage on, C to E is a period with filament voltage and G2 voltage on, D to E is a period for spot knocking, E to F is a period with reduced filament voltage and G2 voltage off, F to G is a period with all voltages off, G to H is a period with reduced filament voltage on, and H to I is a period with all voltages off. Temperatures during the period C through F produce rapid curing of the sealing substance. The periods A through C and F through I also accelerate the curing as compared with curing at room temperature.

Some single-component sealing substances that can be used in the novel method; that is, substances that are heat curable to solid dielectric materials, are SE-100 silicone putty and RTV-133 silicone rubber marketed by General Electric Company, Schenectady, N.Y., and RTV 732 silicone rubber marketed by Dow-Corning, Midland, Mich. A two-component sealing substance that can be used in the novel method is Type E Silastic rubber with Silastic E catalyst marketed by Dow-Corning. The foregoing sealing substances may require a primer, such as Pliobond 1000, marketed by Goodyear Chemicals, Ashland, Ohio, to optimize forming the silicone rubber adhesive bond to the surfaces of the base and stem.

In this specification the term "dielectric" describes a material that is substantially more resistant to arcing than air. Also, the term "sealing" is used to designate a substance that wets the solid surfaces it contacts and maintains that relationship during the period that it is curing and after curing is completed, so that gases are displaced and remain displaced from these surfaces.

A practical method for accelerating the curing depends on an appreciation of several factors. First, the critical region for curing is in the space between the base and the stem immediately adjacent the pins of interest. Second, substantial heat is generated in the tube and is conducted into the stem and pins during the electrical processing of the tube. The heat from electrical processing can produce temperatures above 150° C. in the region between the base and the stem. Third, electrical processing can be conducted soon after the sealing substance is injected into the base-stem assembly. Fourth, some sealing substances can be at least partially cured by heat to produce dielectric materials. Such heat curing can be carried out at temperatures in the range of 100° to 200° C. Thus, by the proper selection of the sealing substance and by applying heat through the stem and pins as by normal electrical processing, the prior method of assembling the base to the tube can be modified to provide a rapid, efficient and cost-effective method.

To this end, the tube, with the base and uncured sealing substance, is loaded on an aging conveyor, the pins are connected to a source of electric power, and the tube is subjected to the usual processing programs, such as spot knocking, cathode activation, and cathode aging. Some patents which describe electrode processing are U.S. Pat. Nos. 2,917,357 to T. E. Nash et al, 3,321,263 to R. G. O'Fallon, 3,698,786 to E. A. Gronka, and 3,966,287 to P. R. Liller.

Figure 3:
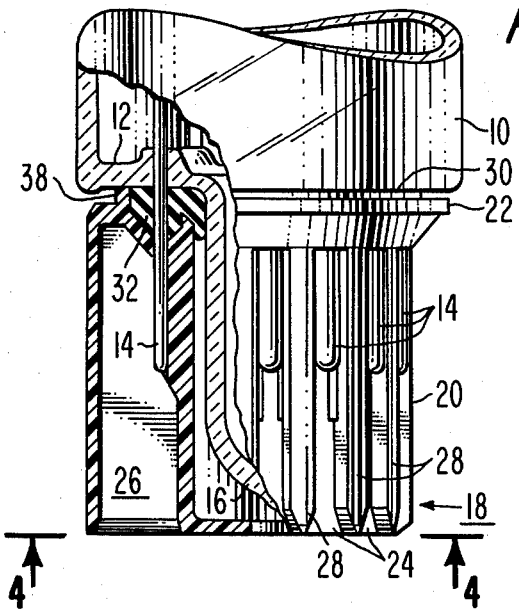
FIG. 3 is a partially sectional, elevational view of a CRT and its base in mating relation.
Figure 4:
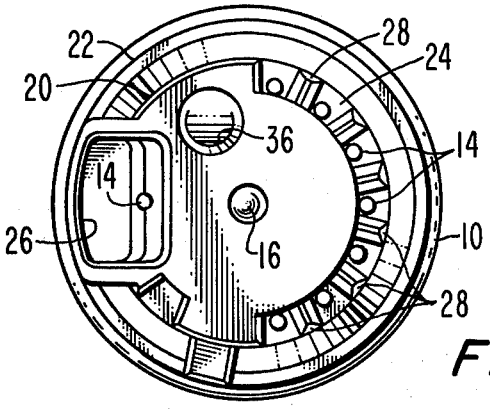
FIG. 4 is a bottom plan view of the CRT and base shown in FIG. 3 taken along the line 4—4 thereof.

FIGS. 3 and 4 show a glass neck portion 10 of a color television picture tube including a base in mating relation similar to the tube shown in FIG. 1 of U.S. Pat. No. 4,076,366, op. cit. This tube and similar structures can be assembled according to the novel method, which will now be described as a detailed example of the novel method. The neck portion 10 is closed at one end with a glass stem 12 which includes a glass wafer and a circular array of stiff conductors or pins 14 which are sealed through the wafer and extend parallel to each other. The stem 12 includes a closed-off exhaust tubulation 16 disposed centrally within the circular array of pins 14.

A base 18 is attached to the stem 12. The base 18 comprises a cylindrical housing 20 open at one end with a radial flange 22 extending radially outward therefrom. The housing 20 fits loosely over the tubulation 16. The outer cylindrical surface of the housing 20 is provided with a series of longitudinal grooves 24 which extend from the flange 22 to the opposite end of the housing 20. The flange 22 has a circular array of apertures therethrough adapted to mate with the pins 14 in the stem 12. The pins 14 extend through the apertures and lie in the grooves 24.

The base 18 is also provided with a tubular chamber or silo 26 disposed coextensively alongside the housing 20. The silo 26 is closed at one end by the flange 22 and is open at the opposite end. The silo encloses therein one of the pins 14, in this case the focusing anode pin, which is intended to carry a substantially higher voltage than the adjacent pins during electrode processing and during tube operation. The base 18 is also provided with radially-extending fins 28 between pairs of adjacent pins 14.

The stem-contacting face 30 of the flange 22 is provided with a recess that is deep enough to allow a mass 32 of dielectric material 32 to be molded therein according to the novel method, and to form a continuous body that will contact selected pins 14 at their interfaces with the stem 12. Typically, the mass 32 has a thickness of about 2.5 mm between the pins. The mass 32 is long enough to encompass the pin 14 in the silo and the two adjacent pins. Each pin 14 is surrounded by a fillet-like cavity in the base which is filled with dielectric material 32 that extends at least 0.15 mm radially out from the pin. The mass of insulating material 32 is cured in place from a viscous or pastelike sealing substance that is injected through the fill hole 36, which is a tubular passage adjacent the outside of the housing 20.

Not all pins will have, or will be adjacent to, pins which will have high voltages applied to them and hence may not need to be surrounded by dielectric material. Hence, when the sealing substance is injected through the fill hole 36, it may encompass only the high-voltage pin 14 and the two adjacent pins. However, in the preferred form of the novel method, the sealing substance encompasses all of the pins 14 and extends from the outside of the tubulation 16 to shoulder 38 on the flange 22.

The base 18 may be assembled to the stem 12 to which it mates by the following procedure. First, the pins 14 are slid through the apertures in the base 18. Then, the base 18 is pushed into position with the flange 22 against the stem 12 where it is held in position by the friction of the pins 14 against the aperture walls of the base 18. Then, a metered amount of a viscous sealing substance is injected through the fill hole 36 and fills the volume around each of the pins 14 between the tubulation 16 and the shoulder 38. In this example, the sealing substance is RTV-133 silicone rubber marketed by General Electric Company, Schenectady, N.Y. RTV-133 silicone rubber will cure at room temperature over long periods of time, but such long-term curing is unacceptable under mass-production conditions, and accelerated curing is necessary. To initiate and accelerate the curing, the tube is placed on an aging conveyor or stationary aging rack, and the processing socket is mounted on the base so as to connect the pins to a power source, being careful not to rock or otherwise move the base in such manner that bubbles form around any of the pins. Then the tube is subjected to its prescribed electrode treatment schedule, whereby the stem becomes heated and initiates and at least partially cures the sealing substance between the base and the stem. In this example, the processing schedule shown in FIG. 2 is applied. When the electrical processing is complete, the sealing substance is substantially cured around each of the pins 14 for a distance of at least 0.15 mm (about 60 mils). As the sealing substance cures, it becomes more viscous, but the adhesive bond or seal to the surfaces of the stem and base remains, making it more difficult to move or separate them. When electrical processing is completed, the substance is sufficiently viscous to prevent the formation of air bubbles in the focus pin area, should the base move with respect to the stem. The remaining sealing substance is at least partially cured, and can complete its curing during normal subsequent production operations without danger of degrading the arcing resistance of the structure.

Comparative studies in the use of different sealing substances between the base and the stem of the tube have yielded the following general conclusions. Hot melt adhesives, such as polyamide resins, have the disadvantages of being softened by heat and may be displaced in subsequent processing. Chemically-cured adhesives, such as epoxy resins, have the disadvantages of differences in thermal expansion and slow curing rates. The usual silicone rubber adhesives have the disadvantages of slow curing rates and of releasing acetic acid and/or the like upon curing, which may be corrosive. The adhesives used in the novel method, by virtue of being at least partially curable by heat, have none of these disadvantages. The cured silicone rubbers employed in the novel method have good dielectric properties, being capable of resisting at least 500 volts per mil. They are inert to the harmful effects of ozone, corona discharge and moisture. Also, they retain their elastic properties over a wide temperature range; typically about −65° C. to +260° C., and are flame retardant.

I claim:

1. A method for assembling a base to the stem of a vacuum electron tube, said stem including a glass wafer and a plurality of electrically-conducting pins therethrough, with one of said pins for carrying a substantially higher voltage than the pins adjacent thereto during the operation of said tube, and said base being adapted to be mated to said stem with said pins extending through apertures in said base, the steps including (1) positioning said base in said mating position on said stem with said pins extending through said apertures, (2) filling substantially all of the space between said base and said stem at least around said one pin with a sealing substance that is at least partially curable by heating to a solid, dielectric material, (3) and then heating said wafer and said pins to such temperatures and for such time periods that said substance starts to cure adjacent said one of said pins and continues to cure outwardly therefrom so as to at least partially cure said substance for at least a substantial distance adjacent said one of said pins.

2. The method defined in claim 1 wherein said step (3) is conducted by electrically processing said tube.

3. The method defined in claim 2 wherein said step of electrically processing said tube includes cathode-aging and spot-knocking.

4. The method defined in claim 2 wherein, immediately after said step of electrically processing said electrodes, said sealing substance is substantially cured around said pins for a distance of at least 0.15 millimeter.

5. The method defined in claim 1 wherein said sealing substance is a room-temperature vulcanizing silicone rubber.

* * * * *